US007357305B2

(12) United States Patent
Ahn et al.

(10) Patent No.: US 7,357,305 B2
(45) Date of Patent: Apr. 15, 2008

(54) BILL DELIVERY APPARATUS FOR WALL-TYPE AUTOMATED-TELLER MACHINE

(75) Inventors: Jin Hyuk Ahn, Suwon-Si (KR); Won Joon Lee, Seoul (KR); Dong Sik Lee, Seoul (KR); You Hoon Yoon, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 263 days.

(21) Appl. No.: 11/134,317

(22) Filed: May 23, 2005

(65) Prior Publication Data

US 2005/0284926 A1 Dec. 29, 2005

(30) Foreign Application Priority Data

Jun. 29, 2004 (KR) ..... 10-2004-0049738
Jun. 29, 2004 (KR) ..... 10-2004-0049739

(51) Int. Cl.
*G07D 13/00* (2006.01)

(52) U.S. Cl. ..... 235/379; 902/8; 902/13; 902/14; 902/17

(58) Field of Classification Search ..... 235/379; 902/8, 13, 14, 17
See application file for complete search history.

(56) References Cited

U.S. PATENT DOCUMENTS 4,262,817 A * 4/1981 Fish ..... 221/130
4,450,978 A * 5/1984 Graef et al. ..... 221/13
6,516,998 B2 * 2/2003 Calder et al. ..... 235/381

* cited by examiner

*Primary Examiner*—Daniel Hess
(74) *Attorney, Agent, or Firm*—Fish & Richardson P.C.

(57) ABSTRACT

A bill delivery apparatus for a wall-type automatic-teller machine according to the present invention is disposed between a cash receiving part and a cash handling part of the machine. The apparatus comprises a main body having a pair of plates spaced apart from each other at both sides thereof; a tray unit adapted to be lifted and lowered within the main body, for temporarily stacking bills introduced from the cash handling part therein; a stopper unit disposed in front of the tray unit to prevent the bills introduced from the cash handling part from deviating from the tray unit; a transfer unit disposed adjacent to the tray unit, for transferring the bills stacked in the tray unit to the cash receiving part; a driving unit for driving the tray unit, the stopper unit, and the transfer unit; and a recovering unit for storing untaken bills that has been returned from the cash receiving part. Thus, present invention provides a bill delivery apparatus for a wall-type automated-teller machine, wherein bills can be smoothly transferred between the cash handling part and the cash receiving part, the number of bills requested by a user can be delivered at a time, and bills untaken due to a user's mistake or carelessness can be separately recovered and stored to enable the machine to be used continuously.

17 Claims, 9 Drawing Sheets

BILL DELIVERY APPARATUS FOR WALL-TYPE AUTOMATED-TELLER MACHINE

BACKGROUND OF THE INVENTION

1. Field of the Invention

The present invention relates to a bill delivery apparatus for a wall-type automated-teller machine, and more particularly, to a bill delivery apparatus for a wall-type automated-teller machine, wherein bills can be smoothly transferred between a cash handling part and a cash receiving part, the number of bills requested by a user can be delivered at a time, and bills untaken due to a user's mistake or carelessness can be separately recovered and stored to enable the machine to be used continuously.

2. Description of the Related Art

In general, an automated-teller machine is used by banks or other financial institutions in order to provide a convenient banking service to their customers. The automated-teller machine is installed in convenience stores or public places in addition to the premises of the banks or financial institutions, and is configured such that customers can deposit or withdraw cash money conveniently whenever needed, using a cash card or a credit card.

Recently, in addition to the money deposit and withdrawal to and from financial institutions, an automated-teller machine has expanded its use and provides a variety of additional services such as insurance bill payment, tax payment, monthly deposit for installment savings, deposit and withdrawal for a time deposit or the like, provision of information, and various official reports.

Further, according to the gradual expansion of five-day-work-a-week, cash needs increase more and more at weekends, and reduction in labor cost has also been required. Thus, additional automated-teller machines are installed and existing automated-teller machines are replaced with new model ones. Accordingly, various types of automated-teller machines with a variety of functions are being developed. As one example, a wall-type automated-teller machine has been proposed.

The wall-type automated-teller machine is constructed such that an operation panel and a cash receiving part are provided on an outer wall surface of a building and thus a user can be provided with a banking service conveniently on the street, as in a vending machine. In addition, since a cash handling part containing cash is provided inside the building, it cannot be removed without using heavy equipment and thus there is no risk that it will be robbed. Furthermore, it can be used wherever and whenever needed, i.e., 24 hours a day and 365 days a year.

However, since the operation panel and the cash receiving part are installed outside a wall, separately from the cash handling part provided inside the wall, an additional bill-transferring means should be provided for smooth transfer of a bill through the wall. A conventional bill-transferring means is constructed to transfer a bill in a single-sheet feeding mode, thereby leading to consumption of a great deal of time for cash deposit and withdrawal, and jamming may frequently occur during transfer thereof over a long distance. Furthermore, in a case where bills remain untaken in the cash receiving part due to a user's mistake or carelessness, there are problems in that they may be lost and thus the use of the automated-teller machine may be interrupted, all of which cause users' dissatisfaction. In particular, when a supervisor of the machine is absent for a long time, for example, during consecutive holidays, the use of the machine is stopped for the whole holidays and users' dissatisfaction will increase.

SUMMARY OF THE INVENTION

The present invention is conceived to solve the aforementioned problems in the art. An object of the present invention is to provide a bill delivery apparatus for a wall-type automated-teller machine, wherein bills can be smoothly transferred between a cash handling part and a cash receiving part, the number of bills requested by a user can be delivered at a time, and bills untaken due to a user's mistake or carelessness can be separately recovered and stored to enable the machine to be used continuously.

A bill delivery apparatus for a wall-type automatic-teller machine according to the present invention for achieving the object is disposed between a cash receiving part and a cash handling part of the machine. The apparatus comprises a main body having a pair of plates spaced apart from each other at both sides thereof; a tray unit adapted to be lifted and lowered within the main body, for temporarily stacking bills introduced from the cash handling part therein; a stopper unit disposed in front of the tray unit to prevent the bills introduced from the cash handling part from deviating from the tray unit; a transfer unit disposed adjacent to the tray unit, for transferring the bills stacked in the tray unit to the cash receiving part; and a driving unit for driving the tray unit, the stopper unit, and the transfer unit. The apparatus may further comprise a recovering unit for storing untaken bills that has been returned from the cash receiving part.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

Hereinafter, a preferred embodiment of the invention will be described in detail with reference to the accompanying drawings.

Figure 1:
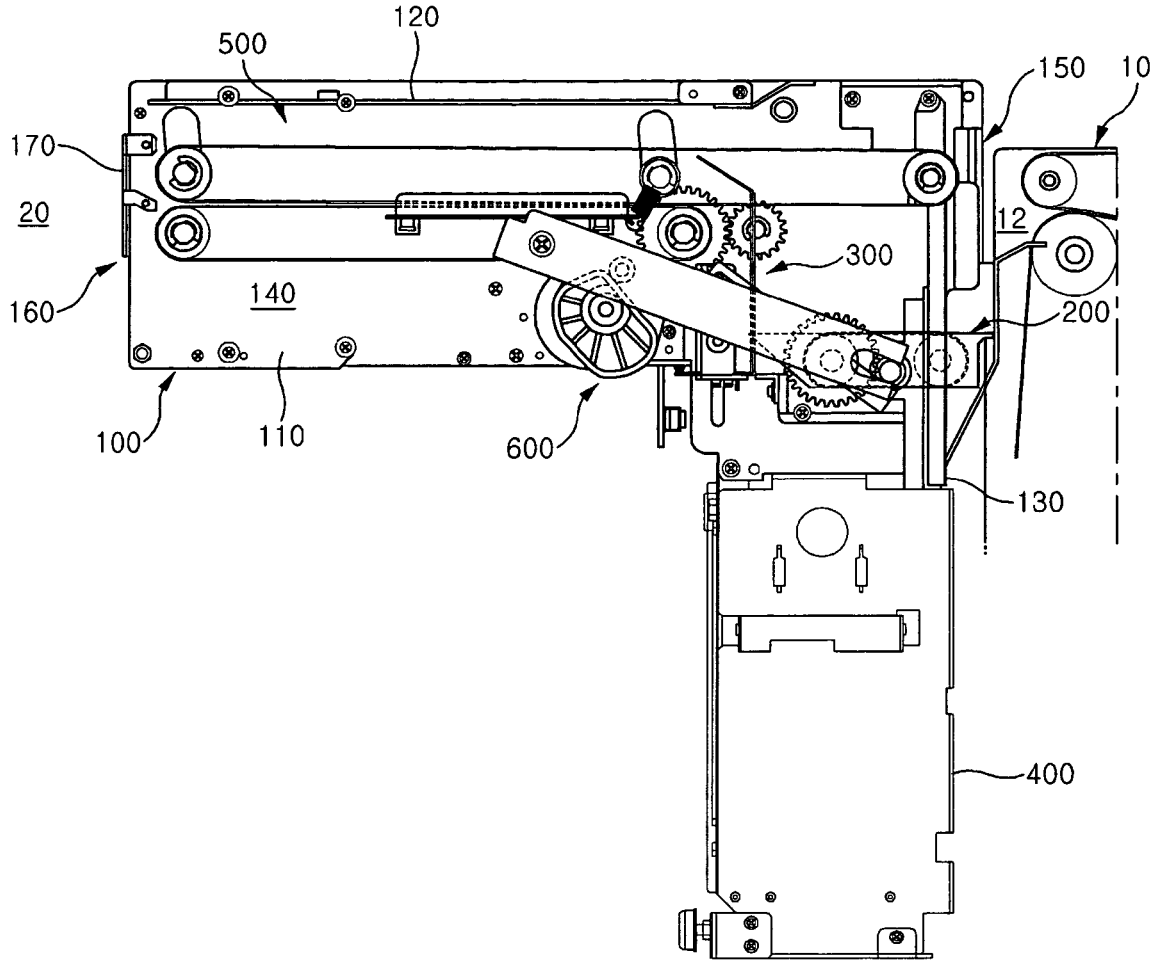
FIG. 1 is a longitudinal sectional view of a bill delivery apparatus for a wall-type automated-teller machine according to the present invention.

FIG. 1 is a longitudinal sectional view of a bill delivery apparatus for a wall-type automated-teller machine according to the present invention.

As shown in FIG. 1, the bill delivery apparatus for a wall-type automated-teller machine according to the present invention comprises a main body 100 with a pair of plates spaced apart from each other at both sides thereof; a tray unit 200 which is installed in front of a cash handling part 10 to be lifted or lowered and on which bills introduced from the cash handling part 10 are stacked temporarily; a stopper unit 300 disposed in front of the tray unit 200 to prevent the bills, which have been introduced from the cash handling part 10, from deviating from the tray unit 200; a recovering unit 400 disposed below the tray unit 200 to store bills untaken at a cash receiving part 20; a transfer unit 500 disposed adjacent to the tray unit 200 to transfer the stacked bills on the tray unit 200 to the cash receiving part 20 and return the untaken bills to the recovering unit 400 from the cash receiving part 20; and a driving unit 600 for driving the tray unit 200, the stopper unit 300 and the transfer unit 500.

The main body 100 comprises a pair of vertical plates 110 spaced apart from each other, and a plurality of connection plates 120 and 130 for connecting the vertical plates 110. The vertical plates 110 and the connection plates 120 and 130 are coupled to one another to form a rectangular hexahedron with a desired space 140 defined therein. The space 140 constitutes a passageway for bills transferred from the cash handling part 10 to the cash receiving part 20. Both ends of the passageway 140 are formed with openings 150 and 160, respectively. The opening 150 on the side of the bill handling part 10 is adjacent to a discharging port 12 of the bill handling part 100. The opening 160 formed on the side of the cash receiving part 20 is exposed to the outside. Here, the opening 160 on the side of the cash receiving part 20 is provided with a vertically slidable shutter 170 to selectively open the opening 160.

Figure 2:
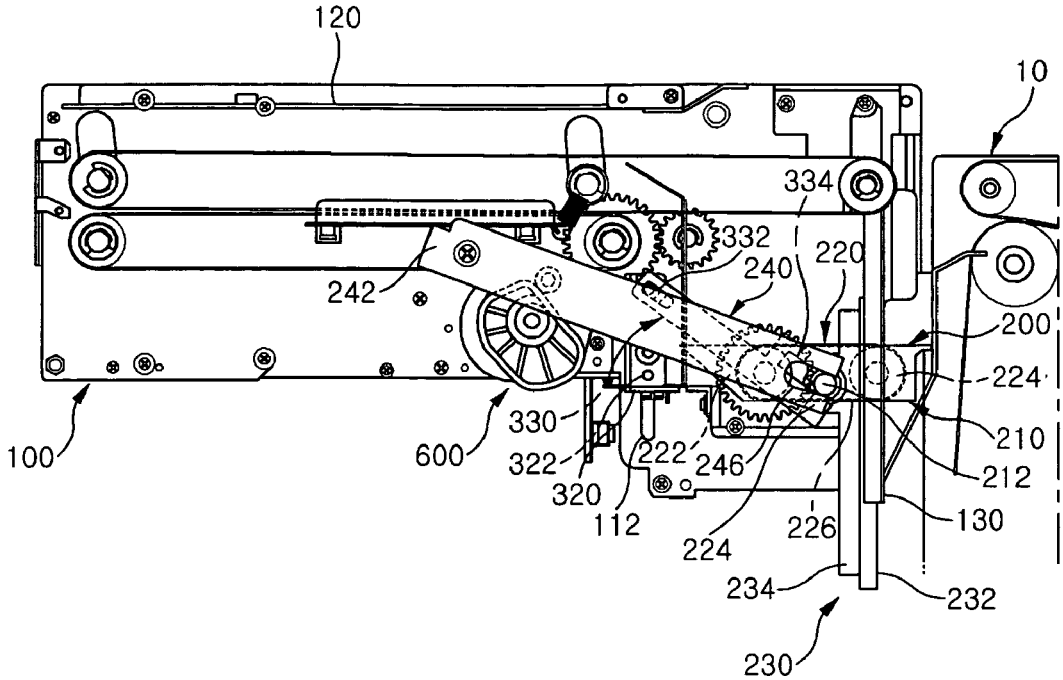
FIG. 2 is a longitudinal sectional view of a tray unit and a stopper unit in the bill delivery apparatus of FIG. 1.

FIG. 2 is a longitudinal sectional view of the tray unit and the stopper unit in the bill delivery apparatus of FIG. 1. Referring to FIG. 2, the tray unit 200 is provided for temporarily stacking bills, which are introduced from the cash handling part 10. Thus, the tray unit 200 is disposed in front of the bill handling part 10. The tray unit 200 comprises a tray 210 that is installed to be lifted and lowered in front of the cash handling part 10 and has an upper surface on which the bills introduced from the cash handling part 10 are stacked; a discharging means 220 that is mounted to protrude above the upper surface of the tray 210 and transfers the stacked bills; a guide means 230 for guiding the directions in which the tray 210 is lifted and lowered; and a first link 240 pivoted by the driving unit 600 to lift and lower the try 210.

The tray 210 is installed horizontally and has the discharging means 220 provided therein. The discharging means 220 comprises a pair of pulleys 222 and 224 spaced apart from each other in the bill-transferring direction, and a belt 226 installed rotatably around the pulleys 222 and 224. The bills introduced from the cash handling part 10 are stacked on the belt 226. The guide means 230 is placed between the tray 210 and the connection plate 130, which is positioned on the side of the cash handling part 10 among the connection plates 120 and 130 of the main body 100. The guide means 230 comprises a vertically elongated guide rail 232 connected to the connection plate 130, and a guide block 234 connected to a back surface of the tray 210 to run along the guide rail 232.

On the other hand, both ends 242 and 244 of the first link 240 are pivotably connected respectively to the vertical plate 110 and the tray 210, and pivoted by the driving unit 600 to lift and lower the tray 210. The both ends 242 and 244 of the first link 240 are pivotably connected as described above, but in different manners. That is, one end 242 of the first link 240, i.e., an end connected to the vertical plate 110, is pivotably connected to the vertical plate 110, and the other end 244 thereof is hingedly connected to the tray 210 so as to lift and lower the tray 210 through the pivoting of the first link 240. The hinge connection between the first link 240 and the tray 210 will be described in grater detail. A protrusion member 212 is formed on a lateral surface of the tray 210, and the other end of the first link 240 is formed with a through-hole 246 through which the protrusion member 212 penetrates to be coupled therein. Here, the through-hole 246 is formed to be elongated in a longitudinal direction of the first link 240 so that the protrusion member 212 can move within the through-hole 246 when the tray 210 is lifted and lowered.

The stopper unit 300 comprises a stopper 310 formed perpendicularly to the direction in which the bills are introduced from the cash handling part 10; a bracket 320 for lifting and lowering the stopper 310; and a second link 330 hingedly connected to the tray 210 and the bracket 320 at both ends thereof so that the bracket 320 can be operated in cooperation with the tray 210.

The stopper 310 is provided vertically, and the bracket 320 is mounted at a lower portion of a front surface of the stopper 310. Further, the vertical plate 110 is provided, at a region in contact with the bracket 320, with a vertically elongated guide slot 112. A lateral surface of the bracket 320 is formed with a protrusion member 322 that passes through and is engaged with the guide slot 112 so that the bracket 320 is lifted and lowered by means of guidance of the guide slot 112.

The second link 330 has the both ends hingedly connected to the tray 210 and the bracket 320, respectively, and an intermediate portion thereof pivotably connected to the vertical plate 110. Thus, the tray 210 and the bracket 320 connected to the both ends of the second link 330 are lifted and lowered in opposite directions by means of the pivoting of the second link 330. That is, when the tray 210 is lifted, the bracket 320 and the stopper 310 coupled thereto are lowered. When the tray 210 is lowered, the stopper 310 is lifted. Here, the second link 330 has through-holes 332 and 334 formed at both ends thereof. Among them, the through-hole 334 formed on the side of the cash handling part 10 is partially opened such that the protrusion member 212 of the tray 210 can be releasably fitted thereinto.

Figure 3:
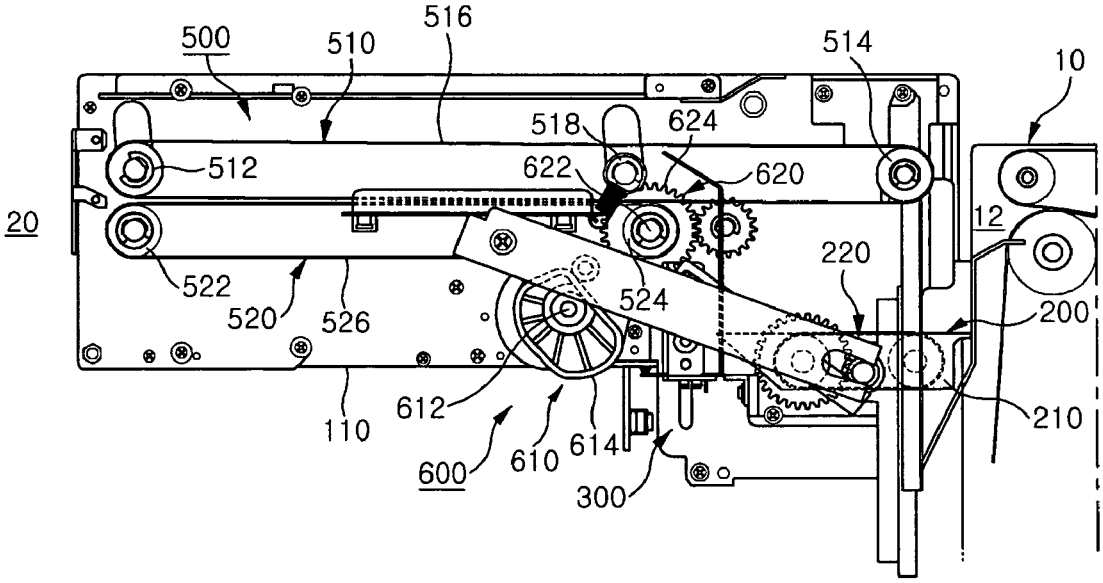
FIG. 3 is a longitudinal sectional view of a transfer unit and a driving unit in the bill delivery apparatus of FIG. 1.

FIG. 3 is a longitudinal sectional view of a transfer unit and a driving unit in the bill delivery apparatus of FIG. 1. The transfer unit 500 shown in FIG. 3 comprises a first transfer means 510 that comes into contact the tray 210 when the tray is lifted, and then transfers the bills; and a second transfer means 520 that is disposed in front of the lifted tray 210 and comes into contact with the first transfer means 510 to transfer the bills, which have been transferred from the tray 210, to the cash receiving part 20 and also functions to return untaken bills from the cash receiving part 20 to the recovering unit (400 in FIG. 1).

The first transfer means 510 is disposed between the cash handling part 10 and the cash receiving part 20. The first transfer means 510 comprises a pair of pulleys 512 and 514 spaced apart from each other in a bill-transferring direction; a belt 516 installed rotatably around the pair of pulleys 512 and 514; and an idle pulley 518 for adjusting the tension of the belt 516. The second transfer means 520 is disposed below a portion of the first transfer means 510 on the side of the cash receiving part 20, and comprises a pair of pulleys 522 and 524 spaced apart from each other in the bill-transferring direction, and a belt 526 installed rotatably around the pair of pulleys 522 and 524. Here, only the second transfer means 520 of the first and second transfer means 510 and 520 is connected to and driven by the driving unit 600. Thus, the first transfer means 510 cannot rotate by itself and guides the bill-transferring direction. In other words, the bills stacked on the tray 210 is transferred to the second transfer means 520 by the discharging means 220 and then transferred to the bill receiving part 20 by the second transfer means 520.

The driving unit 600 comprises a first driving means 610 for driving the tray unit 200 and the stopper unit 300, and a second driving means 620 for driving the transfer unit 500. The first driving means 610 comprises a first driving source 612 disposed below one end of the first link 240, and a cam 614 coupled to the first driving source 612 and circumscribed with the first link 240. In addition, the second driving means 620 comprises a second driving source 622 provided separately from the first driving source 612 and fixed to the vertical plate 110, and a driving gear 624 coupled to the second driving source 622.

Figure 4:
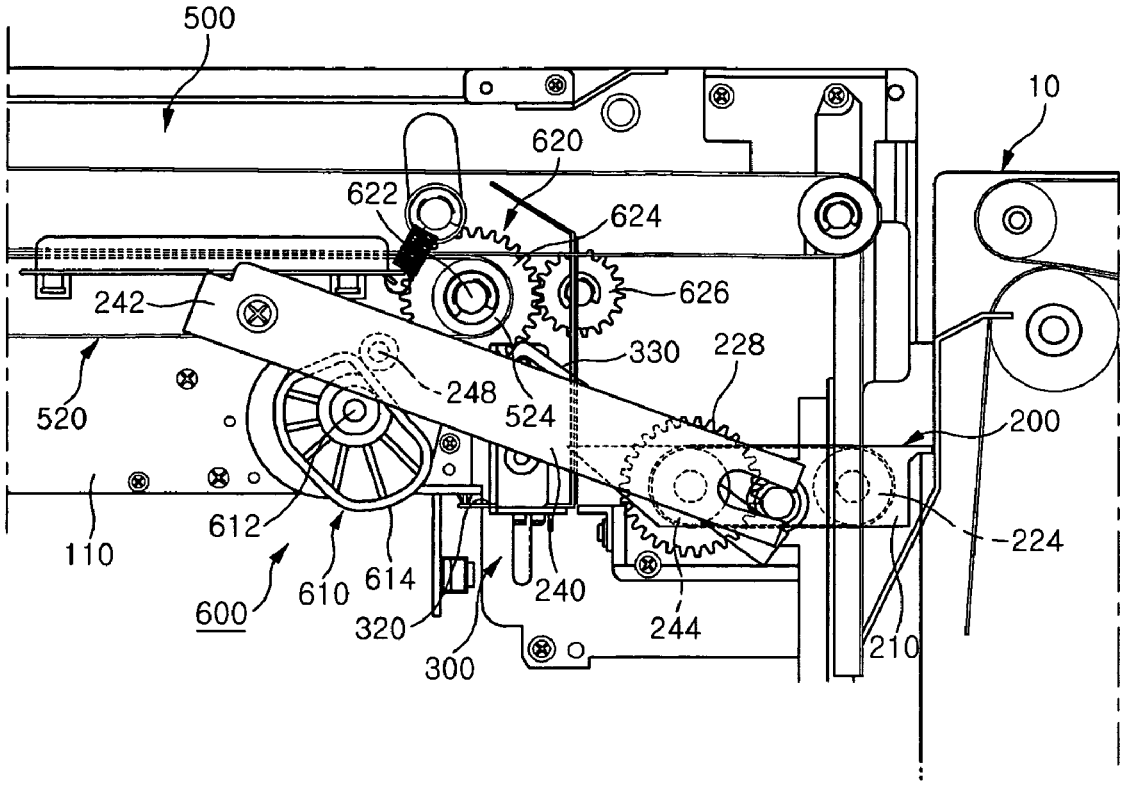
FIG. 4 is an enlarged longitudinal sectional view of the tray unit, the stopper unit, the transfer unit and the driving unit in the bill delivery apparatus of FIG. 1.

FIG. 4 is an enlarged longitudinal sectional view of the tray unit, the stopper unit, the transfer unit and the driving unit in the bill delivery apparatus of FIG. 1.

The connection relationship between the driving unit 600 and other components such as the tray unit 200, the stopper unit 300 and the transfer unit 500 will be described in greater detail with reference to FIG. 4.

The first driving means 610 of the driving unit 600 is disposed below the end 242 of the both ends 242 and 244 of the first link 240, which is pivotably connected to the vertical plate 110. The first driving source 612 is fixed to the vertical plate 110, and the cam 614 is coupled to an output side of the first driving source 612. The cam 614 is circumscribed with the first link 240. Here, the first link 240 is provided with a protrusion member 248 to facilitate the contact with the cam 614. As described above, the both ends 242 and 244 of the first link 240 are pivotably coupled to the vertical plate 110 and the tray 210, respectively, and the both ends of the second link 330 are hingedly coupled respectively to the tray 210 and the bracket 320 and the intermediate portion thereof is pivotably connected to the vertical plate 110.

The second driving source 622 of the second driving means 620 is fixed to the vertical plate 110 and positioned to be coupled to the pulley 524 of the second transfer means 520, i.e., the pulley 524 positioned on the side of the cash receiving part 20. That is, the pulley 522 and the driving gear 624 are coupled to an output side of the second driving source 622. Moreover, an idle gear 626 rotated through engagement with the driving gear 624 is disposed at the rear of the driving gear 624. A driven gear 228 that is to be engaged with the idle gear 626 is coupled to the pulley 222 on the side of the cash handling part 10 among the pulleys 222 and 224 of the discharging means 220. Thus, when the tray 210 is lifted and thus the idle gear 626 and the driven gear 228 are engaged with each other, a driving force generated from the second driving source 622 is transmitted to the discharging means 220 so that the bills can be transferred.

Figure 5:
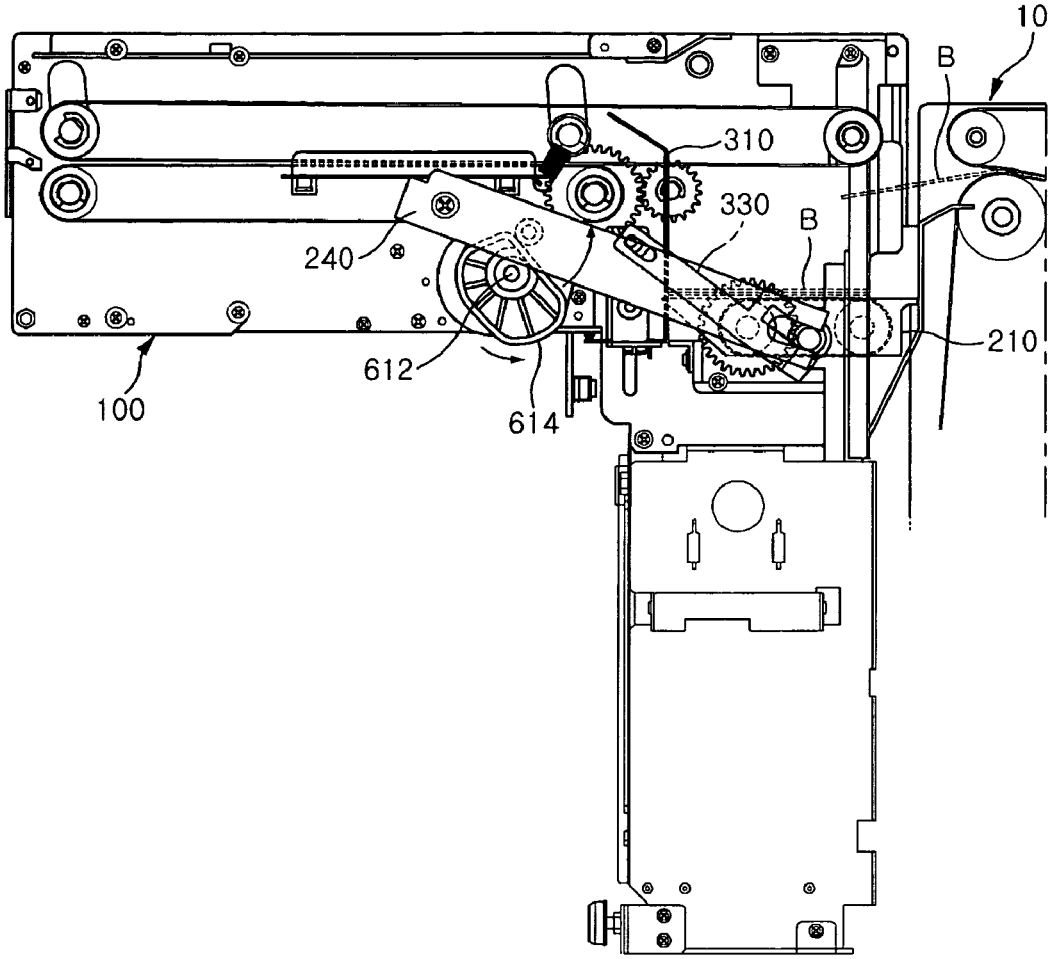
FIGS. 5 to 7 are views illustrating a bill delivery process performed by the bill delivery apparatus.
Figure 6:
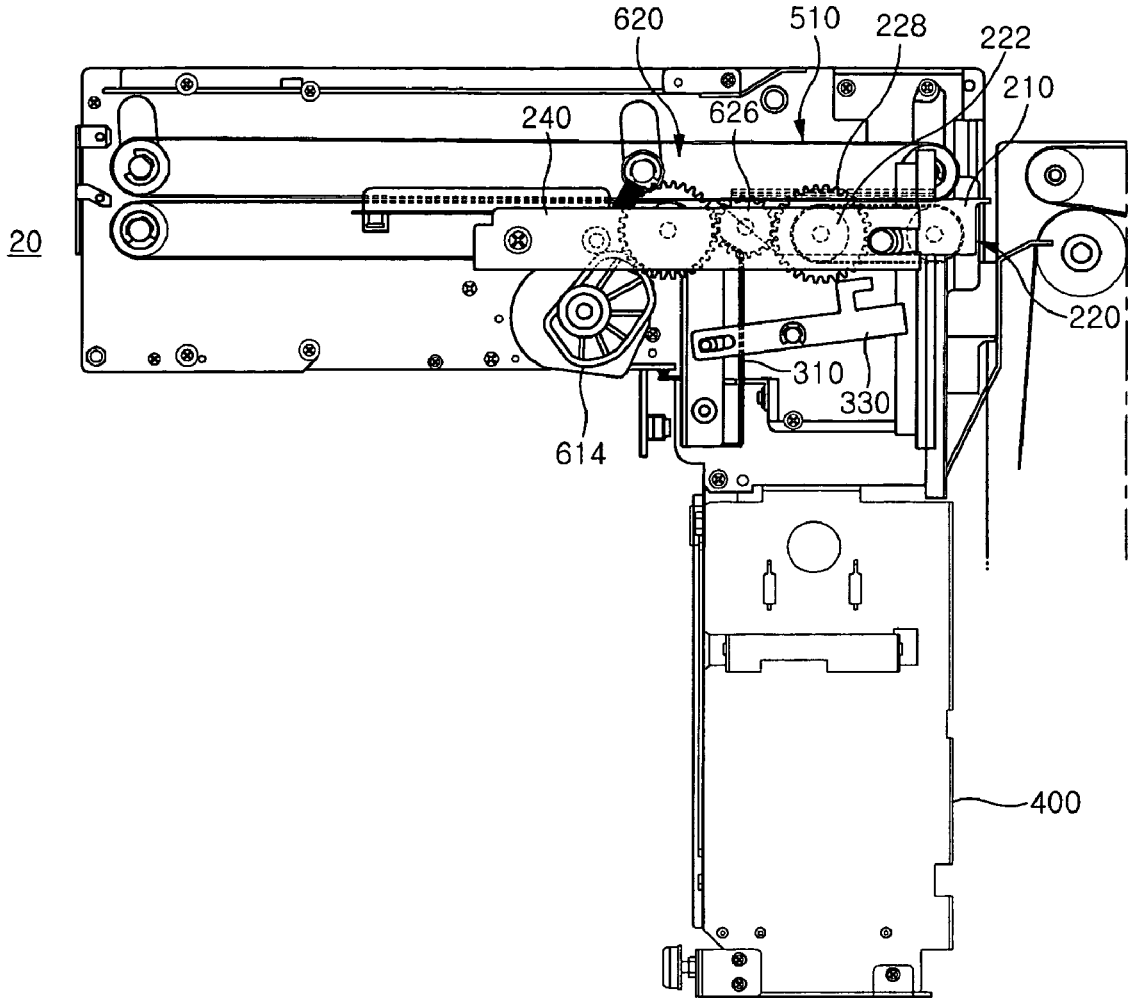
Figure 7:
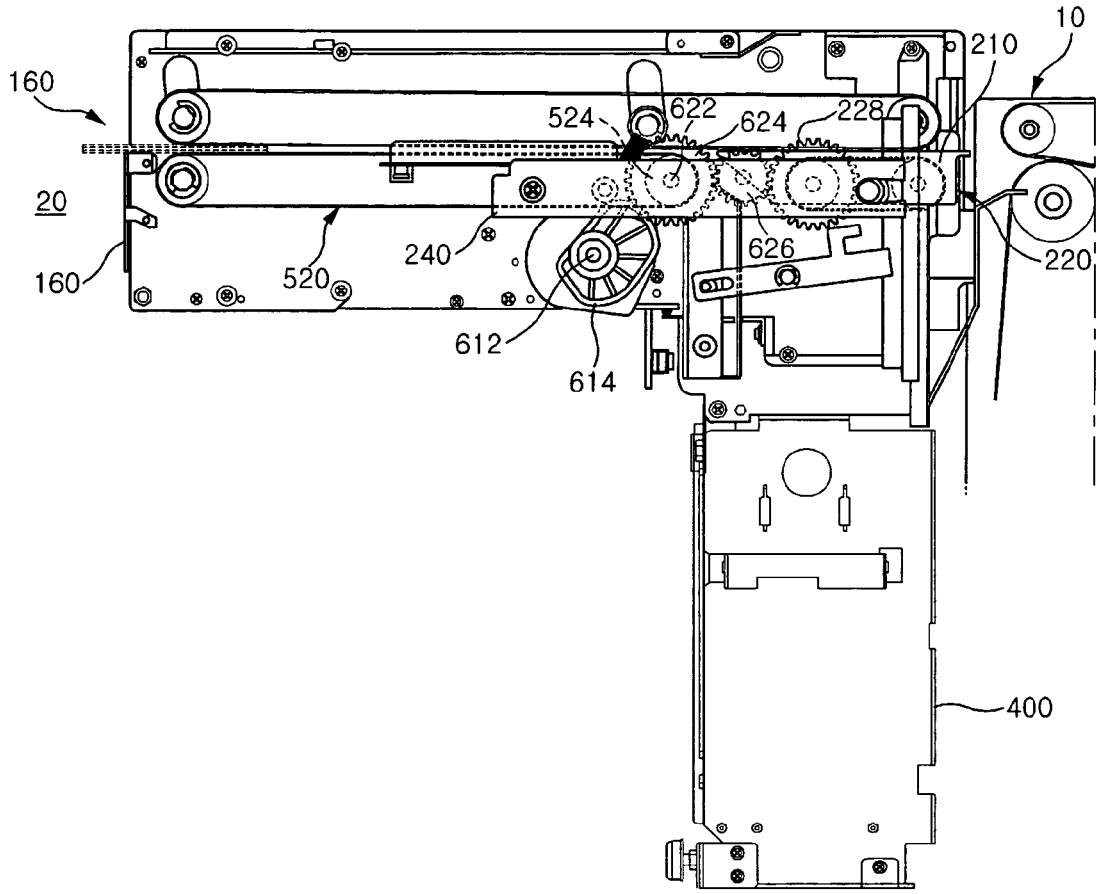

FIGS. 5 to 7 are views illustrating a bill delivery process performed by the bill delivery apparatus. The bill delivery process performed by the bill delivery apparatus of the present invention will be described below with reference to these figures.

As shown in FIG. 5, the tray 210 is positioned in a lowered state so that bills B to be introduced from the cash handling part 10 can be stacked thereon, and the stopper 310 is positioned in a lifted state to prevent the introduced bills B from coming out.

In the aforementioned initial state, when a user operates the automated-teller machine to withdraw bills, the bills are introduced into the main body 100 through the cash handling part 10. At this time, the bills B introduced from the cash handling part 10 are stacked and arranged on the upper surface of the tray 210 while colliding against the stopper 310 positioned perpendicularly to the introduction direction of the bills B. When the number of bills B requested by a user is stacked on the tray 210 in such a manner, the first driving source 612 is operated to rotate the cam 614.

Further, the first link 240 is pivoted by the cam 614 in the direction indicated by an arrow in FIG. 5. The tray 210 is lifted by the first link 240, as shown in FIG. 6. At this time, the stopper 310 is lowered by-means of the pivoting of the second link 330 when the tray 210 is lifted.

On the other hand, the tray 210 is lifted until it comes into contact with the first transfer means 510. While the tray 210 is lifted, the driven gear 228 that is coupled to the pulley 222 of the discharging means 220 on the side of the cash receiving part 20 is engaged with the idle gear 626 of the second driving means 620.

When the tray 210 is completely lifted as shown in FIG. 7, the second driving source 622 is operated to rotate the pulley 524 of the second transfer means 520 on the side of the cash handling part 10 in the direction indicated by an arrow in the figure. At the same time, the driving gear 624 coupled to the pulley 524 is rotated, and the idle gear 626 and the driven gear 228 engaged with the driving gear 624 are also rotated. Thus, the driven gear 228 drives the discharging means 220 so that the bills B stacked on the tray 210 are transferred to the second transfer means 520. The bills B transferred from the tray 210 are transferred to the cash receiving part 20 by the second transfer means 520. When the bills B reach the cash receiving part 20, the shutter 170 is opened and the bills B are delivered to the outside through the opening 160 provided on the side of the cash receiving part 20.

Here, when the bills B stacked on the upper surface of the tray 210 are transferred to the second transfer means 520, the cam 614 is further rotated by the first driving source 612 and the first link 240 is returned to its original position. Accordingly, the tray 210 is lowered to its initial position.

Figure 8:
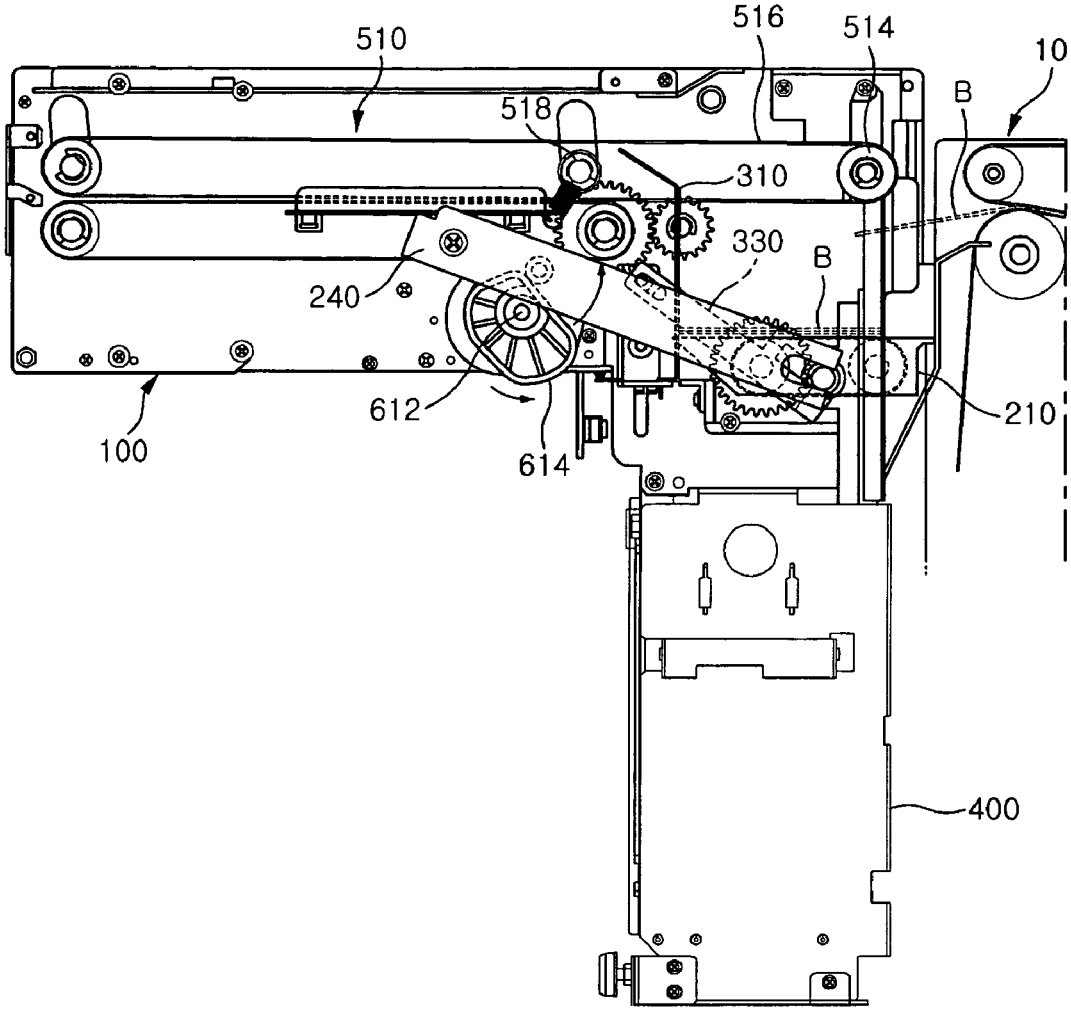
FIGS. 8 to 10 are views illustrating a bill recovering process performed by the bill delivery apparatus.
Figure 9:
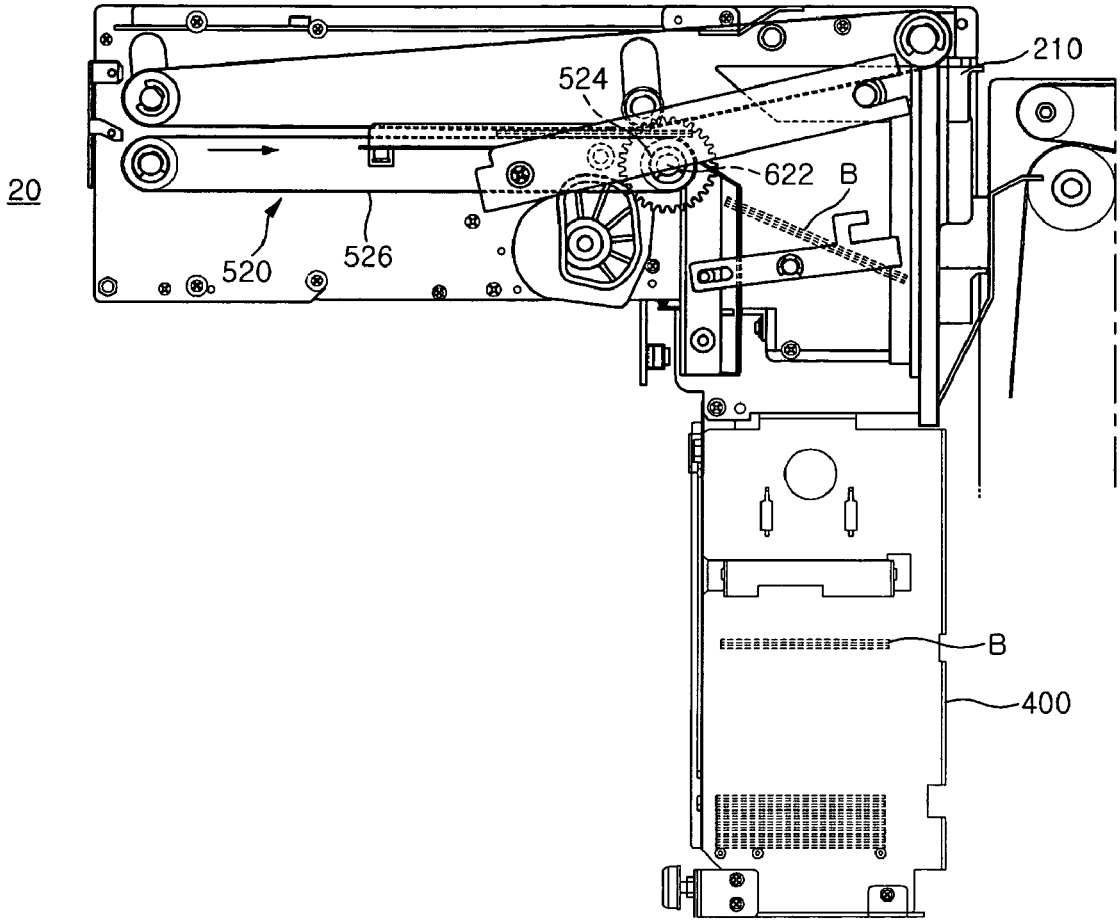
Figure 10:
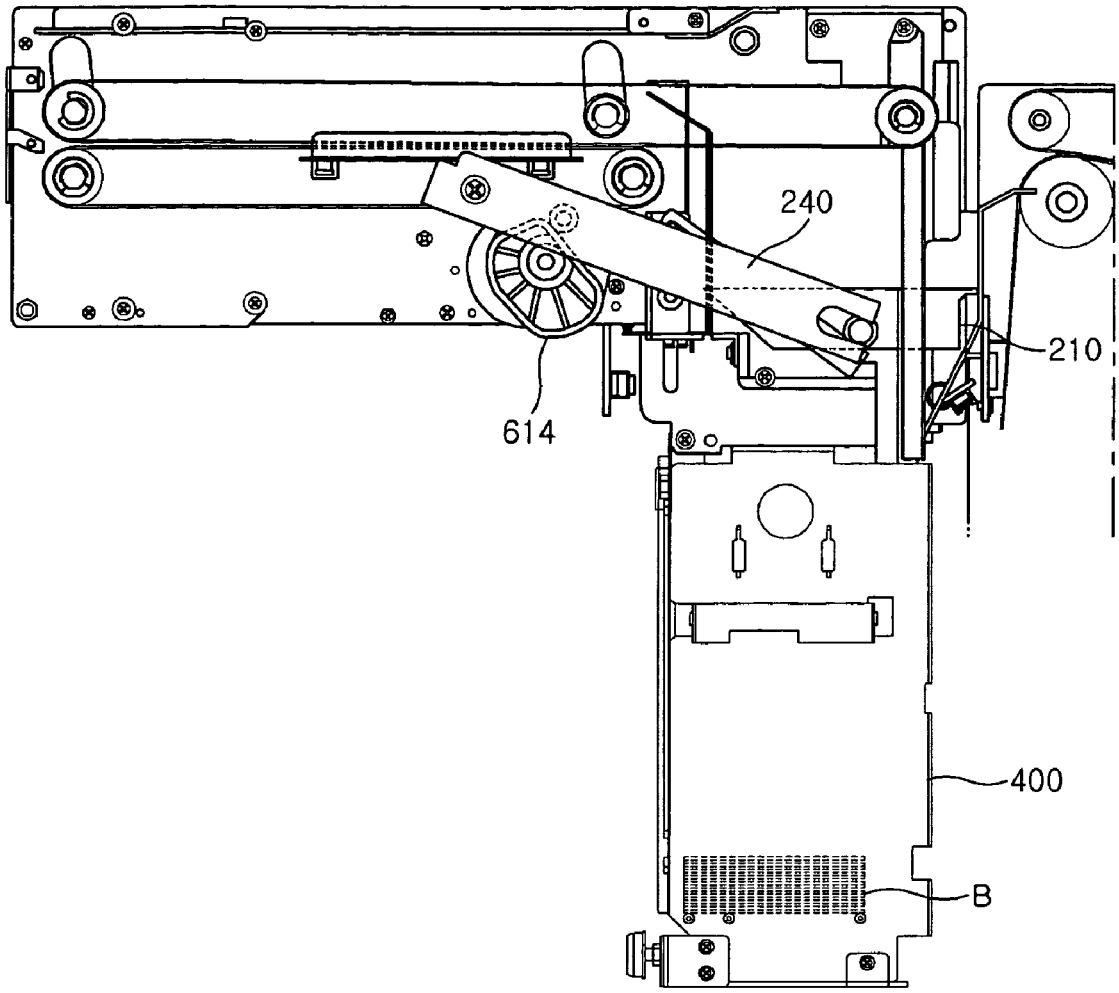

FIGS. 8 to 10 are views illustrating a bill recovering process performed by the bill delivery apparatus. The bill recovering process performed by the bill delivery apparatus will be described below with reference to FIGS. 8 to 10.

The bills delivered according to a user's request stay in the cash receiving part for a certain period of time so that the user can take the bills. Even after the certain period of time passes over, if the bills remain untaken in the cash receiving part, the bills are considered as untaken bills and then recovered.

As shown in FIG. 8, in order to recover the untaken bills B from the cash receiving part 20, the first driving source 612 is operated to rotate the cam 614 coupled to the output side of the first driving source 612, and the first link 240 circumscribed with the cam 614 is pivoted in the direction indicated by an arrow in the figure. The first link 240 lifts the tray 210 that in turn pivots the second link 330, thereby lowering the stopper 310. At this time, the tray 210 is lifted until it comes into contact with the first transfer means 510. Here, the bottom surface of the tray 210 should be placed at a position higher than a bill-transferring path (between the first transfer means and the second transfer means) so as to ensure smooth recovery of the bills B. Therefore, the cam 614 is further rotated than in the bill delivery process to lift the tray 210 such that the bottom surface thereof is placed at a position higher than the bill-transferring path.

Meanwhile, to enable the tray 210 to be lifted to a position higher than the bill-transferring path, the pulley 514 of the first transfer means 510 on the side of the cash handling part is lifted. When the pulley 514 is lifted as above, the tension of the first belt 516 is loosened and thus the bills B cannot be smoothly transferred. To prevent this, the first transfer means 510 is provided with an idle pulley 518.

As shown in FIG. 9, when the tray 210 is completely lifted, the second driving source 622 is operated to drive the second transfer means 520. At this time, the bills B are returned to the recovering unit 400 by the belt 516 of the second transfer means 520. The returned bills B fall down below the tray 210 via the pulley 524 of the second transfer means 520 on the side of the cash handling part 10, and the fallen-down bills are stored in the recovery unit 400.

When the bills B are stored in the recovering unit 400, the cam 614 is further rotated to cause the first link 240 to return to its original position, as shown in FIG. 10. Furthermore, the tray 210 is lowered to its initial position, and the automated-teller machine is returned to its original state for the next job.

As described above, since the bill delivery apparatus for a wall-type automated-teller machine according to the invention is provided between a cash handling part and a cash receiving part, there are advantages in that bills can be smoothly delivered and the number of bills requested by a user can be delivered at a time. Furthermore, in a case where the bills remains untaken in the cash receiving part due to a user's mistake or carelessness, the untaken bills can be separately recovered and stored so that the machine can be continuously used without interruption. Thus, there are advantages in that frequent interruption of the machine can be avoided, thereby improving the user's satisfaction and facilitating maintenance by a supervisor.

Although the structure and operation of the bill delivery apparatus for a wall-type automated-teller machine according to the preferred embodiment of the present invention have been described and illustrated with reference to the accompanying drawings, it is only for illustrative purposes. It will be readily understood by those skilled in the art that various modifications and changes can be made thereto without departing from the spirit and scope of the present invention defined by the appended claims.

What is claimed is:

1. A bill delivery apparatus for an automatic-teller machine, the bill delivery apparatus being disposed between a cash receiving part and a cash handling part of the machine, the apparatus comprising:

a main body having a pair of plates spaced apart from each other at both sides thereof;

a tray unit adapted to be lifted and lowered within the main body, for temporarily stacking bills introduced from the cash handling part therein;

a stopper unit disposed in front of the tray unit to prevent the bills introduced from the cash handling part from deviating from the tray unit;

a transfer unit disposed adjacent to the tray unit, for transferring the bills stacked in the tray unit to the cash receiving part; and a driving unit for driving the tray unit, the stopper unit, and the transfer unit;

wherein the tray unit comprises a tray installed to be lifted and lowered in front of the cash handling part and having an upper surface on which the bills are stacked; a guide means disposed at a side of the tray to guide directions in which the tray is lifted and lowered; and a first link with both ends hingedly connected to the plate and tray, the fist link being pivoted by the driving unit to lift the tray.

2. The apparatus as claimed in claim 1, wherein a discharging means for transferring the stacked bills is further provided in the tray unit.

3. The apparatus as claimed in claim 2, wherein the discharging means comprises a pair of pulleys and a belt rotated by the pair of pulleys.

4. The apparatus as claimed in claim 1, wherein the stopper unit comprises a stopper formed perpendicularly to a direction in which the bills are introduced from the cash handling part; a bracket for lifting and lowering the stopper; and a second link with both ends hingedly connected to the tray and the bracket, respectively, such that the bracket can be operated in cooperation with the tray.

5. The apparatus as claimed in claim 4, wherein the stopper is lowered when the tray is lifted, and the stopper is lifted when the tray is lowered.

6. The apparatus as claimed in claim 1, wherein the transfer unit comprises a first transfer means coming into contact with the tray to transfer the bills when the tray is lifted; and a second transfer means disposed adjacent to the first transfer means to transfer the bills transferred from the tray to the cash receiving part and to return the untaken bills from the cash receiving part to the recovering unit.

7. The apparatus as claimed in claim 6, wherein each of the first transfer means and the second transfer means comprises a pair of pulleys and a belt rotated by the pair of pulleys.

8. The apparatus as claimed in claim 7, wherein each of the first transfer means and the second transfer means further comprises an idle pulley for adjusting the tension of the belt.

9. The apparatus as claimed in claim 1, wherein the driving unit comprises a first driving means for driving the tray unit and the stopper unit, and a second driving means for driving the transfer unit.

10. The apparatus as claimed in claim 9, wherein the first driving means comprises a first driving source, and a cam coupled to the first driving source and circumscribed with the first link.

11. The apparatus as claimed in claim 9, wherein the transfer unit comprises a first transfer means disposed between the cash receiving part and the cash handling part to transfer the bills while coming into contact with the tray when the tray is lifted, and a second transfer means disposed in front of the lifted tray and adjacent to the first transfer means to transfer the bills transferred from the tray to the cash receiving part and to return the untaken bills from the cash receiving part to the recovering unit; each of the first transfer means and the second transfer means comprises a pair of pulleys and a belt rotated by the pair of pulleys; and the second transfer means comprises a second driving source to which one of the pulleys of the second transfer means is coupled.

12. The apparatus as claimed in claim 11, wherein a discharging means comprising a pair of pulleys and a belt rotated by the pair of pulleys is provided in the tray unit; a driving gear and a driven gear are coupled to the second driving source and the pulley of the pair of pulleys on the side of the second driving means, respectively; and the driving gear and the driven gear are engaged with each other when the tray is lifted.

13. A bill delivery apparatus for an automatic-teller machine, the bill delivery apparatus being disposed between a cash receiving part and a cash handling part of the machine, the apparatus comprising:

a main body having a pair of plates spaced apart from each other at both sides thereof;

a tray unit adapted to be lifted and lowered within the main body, for temporarily stacking bills introduced from the cash handling part therein;

a stopper unit disposed in front of the tray unit to prevent the bills introduced from the cash handling part from deviating from the tray unit;

a transfer unit disposed adjacent to the tray unit, for transferring the bills stacked in the tray unit to the cash receiving part; and a driving unit for driving the tray unit, the stopper unit, and the transfer unit;

a recovering unit for storing untaken bills that has been returned from the cash receiving part, wherein the transfer unit returns the untaken bills from the cash receiving part to the recovering unit, wherein the tray unit comprises a tray installed to be lifted and lowered in front of the cash handling part and having an upper surface on which the bills are stacked; a guide means disposed at a side of the tray to guide directions in which the tray is lifted and lowered; and a first link with both ends hingedly connected to the plate and tray, the fist link being pivoted by the driving unit to lift the tray.

14. The apparatus as claimed in claim 13, wherein a discharging means for transferring the stacked bills is further provided in the tray unit.

15. The apparatus as claimed in claim 13, wherein the stopper unit comprises a stopper formed perpendicularly to a direction in which the bills are introduced from the cash handling part; a bracket for lifting and lowering the stopper; and a second link with both ends hingedly connected to the tray and the bracket, respectively, such that the bracket can be operated in cooperation with the tray.

16. The apparatus as claimed in claim 13, wherein the transfer unit comprises a first transfer means coming into contact with the tray to transfer the bills when the tray is lifted; and a second transfer means disposed adjacent to the first transfer means to transfer the bills transferred from the tray to the cash receiving part and to return the untaken bills from the cash receiving part to the recovering unit.

17. The apparatus as claimed in claim 13, wherein the driving unit comprises a first driving means for driving the tray unit and the stopper unit, and a second driving means for driving the transfer unit.

* * * * *